US006613155B2

(12) United States Patent
Clark

(10) Patent No.: US 6,613,155 B2
(45) Date of Patent: Sep. 2, 2003

(54) METHOD FOR SERVICING FIREFIGHTER'S TURNOUT GEAR

(76) Inventor: David L. Clark, 3428 Stembler Ridge, Douglasville, GA (US) 30135

( * ) Notice: Subject to any disclaimer, the term of this patent is extended or adjusted under 35 U.S.C. 154(b) by 49 days.

(21) Appl. No.: 09/965,552

(22) Filed: Sep. 27, 2001

(65) Prior Publication Data

US 2002/0129836 A1 Sep. 19, 2002

Related U.S. Application Data

(60) Provisional application No. 60/277,009, filed on Mar. 19, 2001.

(51) Int. Cl.[7] ..... B08B 7/04; D06F 35/00

(52) U.S. Cl. ..... 134/12; 134/18; 134/19; 134/30; 134/33; 134/42; 134/113; 134/115 R; 134/105; 134/108; 8/158; 68/13 R; 68/18 C

(58) Field of Search ..... 134/12, 18, 19, 134/30, 33, 42, 113, 115 R, 105, 108; 8/158; 68/13 R, 18 C

(56) References Cited

U.S. PATENT DOCUMENTS

| | | | | |
|---|---|---|---|---|
| 3,531,059 | A | 9/1970 | Walker | 242/86.2 |
| 3,736,774 | A | 6/1973 | Shibata | 68/18 R |
| 3,771,334 | A | 11/1973 | Quackenbush | 68/18 C |
| 4,158,248 | A | 6/1979 | Palmer | 15/321 |
| 4,781,041 | A | 11/1988 | Fowler | 68/18 F |
| 4,797,128 | A | 1/1989 | Fowler | 8/137 |
| 4,862,551 | A | 9/1989 | Martinez et al. | 15/321 |
| 4,897,122 | A | 1/1990 | Schreiber et al. | 134/29 |
| 4,909,050 | A | 3/1990 | Sewter et al. | 68/18 R |
| 5,165,139 | A | 11/1992 | Oxman | 15/321 |
| 5,233,796 | A | 8/1993 | Mazalewski, Jr. | 51/426 |
| 5,287,589 | A | 2/1994 | Hughes | 15/321 |
| 5,334,291 | A | 8/1994 | Gavlin et al. | 202/234 |
| 5,437,296 | A | 8/1995 | Citino | 134/108 |
| 5,469,598 | A | 11/1995 | Sales | 15/321 |
| 5,590,671 | A | 1/1997 | Yachera | 134/95.1 |
| 5,607,652 | A | 3/1997 | Hellmuth et al. | 422/300 |
| 5,993,739 | A | 11/1999 | Lyon | 422/31 |
| 6,233,772 | B1 * | 5/2001 | McClain et al. | 8/159 |

OTHER PUBLICATIONS

Laundry Vehicle, Publication No. 09–002132 [JP 9002132A], Inventor: Ikeda Hiromitsu, (Abstract), Published Jan. 7, 1997, "Dialog Web Command Mode" (Jan. 19, 2001).

Laundry Vehicle, Publication NO.: 05–185870 [JP 5185870A], Inventor: Ikeda Hiromitsu, (Abstract), "Dialog Web Command Mode" (Feb. 19, 2001), Published Jul. 27, 1993.

* cited by examiner

*Primary Examiner*—Zeinab El-Arini
(74) *Attorney, Agent, or Firm*—Synnestvedt & Lechner LLP

(57) ABSTRACT

A method for servicing firefighter's turnout gear includes the step of transporting a mobile servicing facility in proximity to a fire department facility. The mobile servicing facility carries cleaning equipment for cleaning firefighter's turnout gear. For example, the cleaning equipment may include a cleaning machine for use with a carbon dioxide-based cleaning agent, a solvent, or laundry equipment. The method also includes the steps of operating the cleaning equipment to clean turnout gear of the fire department facility, and transporting the mobile servicing facility away from the fire department facility. Optionally, the mobile servicing facility also carries repairing equipment, supplies for repairing the turnout gear, power generation equipment, and/or a tracking system for preparing a report of services performed on the turnout gear.

23 Claims, 3 Drawing Sheets

METHOD FOR SERVICING FIREFIGHTER'S TURNOUT GEAR

RELATED APPLICATIONS

This application claims the benefit of U.S. Provisional Patent Application No. 60/277,009 filed Mar. 19, 2001, the disclosure of which is hereby incorporated herein by reference.

FIELD OF THE INVENTION

The present invention relates generally to servicing of firefighter's turnout gear and particularly to a method for cleaning and repairing same.

BACKGROUND OF THE INVENTION

Firefighters in volunteer fire departments as well as in paid industrial fire brigades wear specialized protective turnout gear when fighting fires. This turnout gear may include "structural" and "proximity" gear such as pants, coats, gloves, boots, helmets, hoods, etc. While fighting fires, dirty, harmful, and sometimes toxic substances soil and/or contaminate the turnout gear.

Contaminants can harm the firefighter and the turnout gear, in various ways. Contaminants include (1) molecules which permeate and remain within the turnout gear, and (2) visible solid particulate which remains on the turnout gear. These contaminants will likely contact the firefighter or others and many can cause disease and death.

Contaminated turnout gear is dangerous. For example, gear contaminated with hydrocarbons does not effectively reflect heat and may thereby cause heat stress in a firefighter. Turnout gear sufficiently soiled with hydrocarbons tends to readily conduct electricity and gear soiled with oil, grease, etc. may ignite, causing significant danger to the firefighter. Additionally, contaminants may damage the turnout gear itself, e.g. resulting in weakened fabrics or loose thread or seam sealing tape that may easily tear and admit contaminants.

It is known that cleaning and repair of turnout gear is possible and necessary for optimum safety to firefighters and others. The National Fire Protection Association is a non-regulatory body that establishes best practices guidelines for the fire fighting industry. In approximately February 2001, the NFPA adopted the 1851 standard. This standard prescribes routine cleaning of turnout gear at least every six months, sets forth standards for cleaning and repairing turnout gear, and recommends recordkeeping practices to document cleaning and repair of turnout gear. Such cleaning and repair is most safely and effectively accomplished by specially trained personnel using purpose-specific cleaning and repair equipment and supplies.

Unfortunately, most fire departments do not properly clean and maintain their turnout gear. This is primarily due to the length of time required to service a given set of turnout gear and the lack of properly trained servicing personnel. The necessary maintenance personnel, expensive cleaning and repair equipment and related supplies are typically not available on-site at a fire department, so it is usually necessary to send the turnout gear to a specialized servicing facility. Because there are few turnout gear servicing facilities relative to the number of fire departments, this typically involves sending the turnout gear out-of-state, having the turnout gear cleaned, dried, and repaired, and having the turnout gear sent back to the fire department and returned to service. Accordingly, it is typically necessary to take the turnout gear out of service for approximately eight (8) to ten (10) days.

Many paid firefighters work 24-hour shifts separated by 48 hour periods. Such a firefighter's turnout gear must be cleaned and repaired within those 48 hours so it is available when needed. This is often impossible. In volunteer fire departments, in which turnout gear is often shared by more than one firefighter, the turnout gear must typically be continuously available. Accordingly, any servicing removes the turnout gear from service and risks its unavailability when needed. To minimize the amount of time that the turnout gear is unavailable, turnout gear is typically serviced less frequently than is recommended. The resulting poorly maintained turnout gear is dangerous to firefighters, as described above. Purchasing or renting additional sets of "backup" turnout gear is cost prohibitive, particularly for smaller, volunteer fire departments. Accordingly, some fire departments clean the turnout gear in-house, which results in improper cleaning and contamination of cleaning equipment. Typically, fire departments do no repair their own gear in-house.

Accordingly, what is needed is a method for cleaning turnout gear that reduces the amount of time required for servicing of turnout gear and reduces the amount of time that turnout gear is out of service, and which can thereby promote more frequent servicing of turnout gear, resulting in turnout gear that is safe for firefighters.

SUMMARY OF THE INVENTION

The present invention provides a method for servicing firefighters's turnout gear which reduces the amount of time required for servicing of turnout gear and reduces the amount of time that turnout gear is out of service, and which thereby promotes more frequent servicing of turnout gear and turnout gear that is safer for firefighters. Conceptually, the present invention includes transporting the servicing equipment to the turnout gear, rather than transporting the turnout gear to the servicing equipment.

In one embodiment, the inventive method includes the step of transporting a mobile servicing facility in proximity to a fire department facility. The mobile servicing facility carries cleaning equipment for cleaning firefighter's turnout gear. For example, the cleaning equipment may include a cleaning machine for use with a carbon dioxide-based cleaning agent, a solvent, or laundry equipment. Optionally, the mobile servicing facility also carries repairing equipment, supplies for repairing the turnout gear, power generation equipment, and/or a record keeping, i.e. tracking, system for preparing a report of services performed on the turnout gear. The method also includes steps of operating the cleaning equipment to clean turnout gear at the fire department facility, and transporting the mobile servicing facility away from the fire department facility.

DETAILED DESCRIPTION

Figure 1:
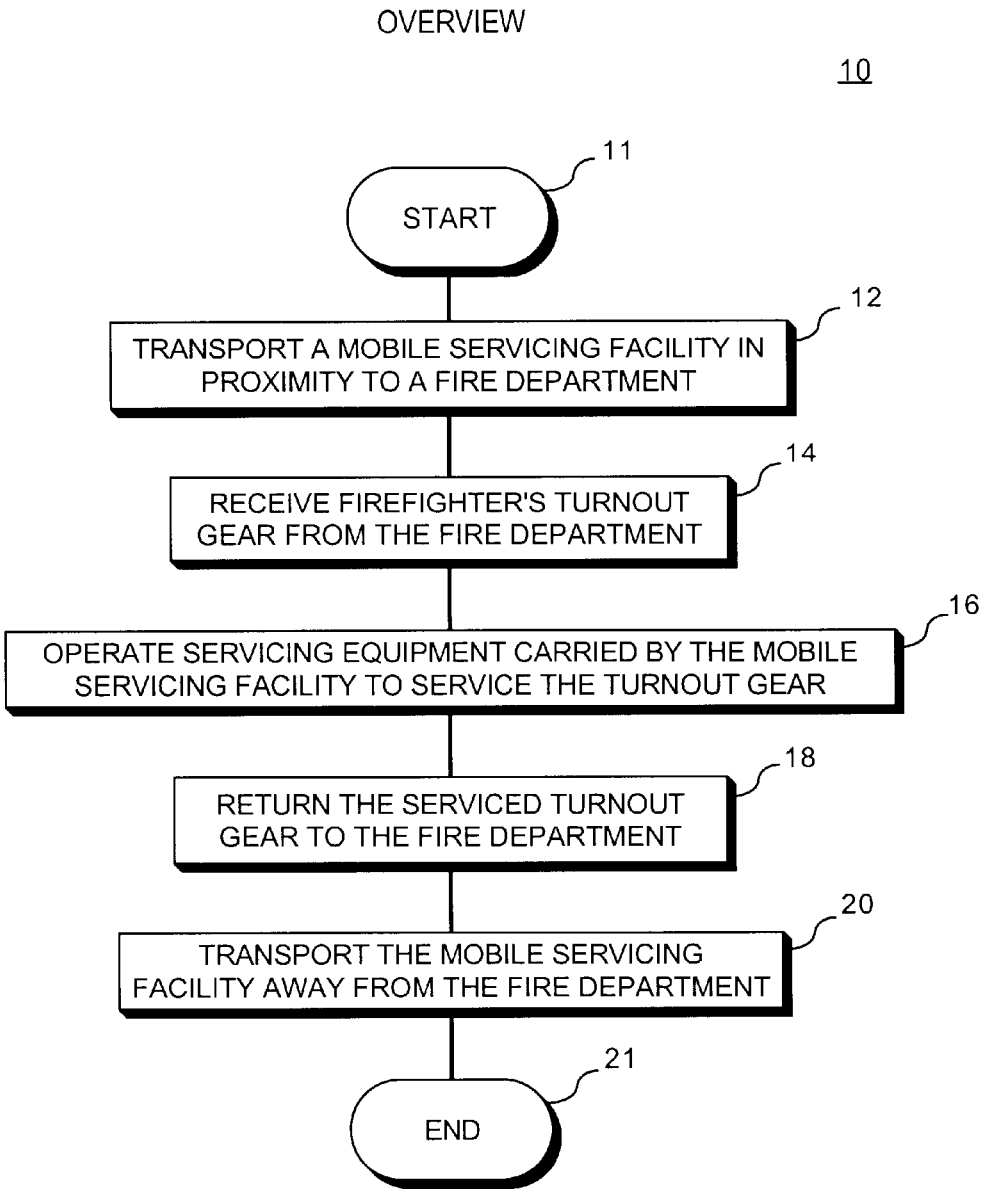
FIG. 1 is a flow diagram providing an overview of logic for servicing firefighters's turnout gear in accordance with the present invention.

FIG. 1 is a flow diagram 10 providing an overview of logic for servicing firefighter's turnout gear in accordance with the present invention. An exemplary method in accordance with FIG. 1 is discussed in detail with reference to FIG. 2. As shown in FIG. 1, the method starts with transportation of a mobile servicing facility in proximity to a fire department, as shown at steps 11 and 12. For example, the mobile servicing facility may be transported near or onto the premises of a fire department. The mobile servicing facility carries equipment for servicing, e.g. cleaning and/or repairing, firefighter's turnout gear, as discussed further below with reference to FIG. 2. Thus, unlike prior art methods, the servicing equipment is brought to the turnout gear.

Firefighter's turnout gear from the fire department is then received at the mobile servicing facility, as shown at step 14. For example, a firefighter may drop off his turnout gear at the end of his working shift. An operator, such as the driver or a rider traveling with the mobile servicing facility, may be specially trained in cleaning and/or repairing turnout gear. For example, manufacturers of turnout gear offer training and/or verification programs to ensure that manufacturer-approved procedures for servicing turnout gear are followed.

The operator next operates the servicing equipment carried by the mobile servicing facility to service the turnout gear, as shown in step 16. Any suitable servicing steps may be performed, including any suitable cleaning or repairing method known in the art. For example, this step may be performed while the mobile servicing facility remains in proximity to, e.g. parked on the premises of the fire department. In this manner, the turnout gear is quickly and efficiently serviced and immediately made available for use by firefighters in fighting fires. Time for shipping the turnout gear to and from the servicing facility is virtually eliminated. Typically, the turnout gear may be completely serviced in a couple of hours, i.e. in significantly less time than a typical firefighter is off-duty. In the case of an unexpected emergency, the turnout gear may be retrieved from the mobile servicing facility and immediately returned to service, even if the servicing is not yet complete, when the mobile servicing facility remains in proximity to the fire department.

After servicing is complete, the serviced turnout gear is returned to the fire department, as shown at step 18. The mobile servicing facility is then transported away from the fire department, e.g. to another fire department, and the process ends, as shown at steps 20 and 21. Advantageously, this method allows a fire department, as needed, to use the expertise of a trained servicing technician and to have the relatively expensive servicing equipment on-site, without having to purchase, store and operate the equipment. Because the gear can be returned to service before it is needed by a firefighter, firefighters and fire departments will more readily service their gear properly, e.g. in accordance with NFPA 1851 guidelines, making the turnout gear safer for use by firefighters.

Figure 2:
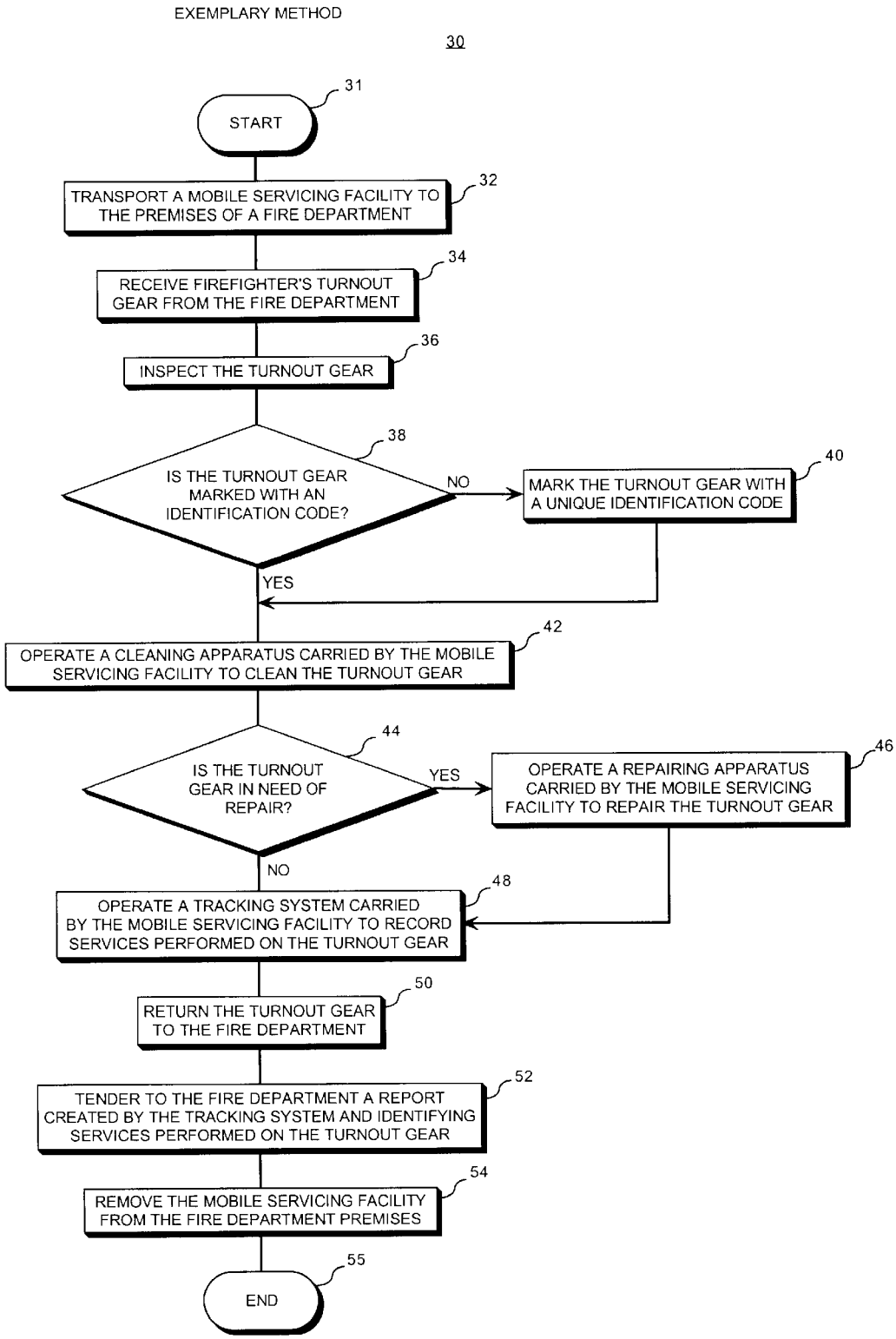
FIG. 2 is a flow diagram providing a detailed view of logic of an exemplary embodiment in accordance with FIG. 1.

FIG. 2 is a flow diagram 30 providing a detailed view of logic of an exemplary embodiment in accordance with FIG. 1. In the example of FIG. 2, the method starts with transportation of a mobile servicing facility onto the premises of a fire department, as shown at steps 31 and 32. The mobile servicing facility includes servicing equipment for servicing turnout gear carried on a suitably sturdy carrier. A trailer towable by a motor vehicle, or a tractor/trailer or truck-like motor vehicle has been found to be a suitably sturdy carrier. Equipment for servicing turnout gear is typically large and heavy and usually not considered to be "portable." Such equipment may include at least cleaning equipment or repairing equipment, and preferably both. Various cleaning and repairing equipment are well known in the art and any suitable cleaning and repairing equipment may be used. For example, the cleaning equipment may include a water-based washing machine (laundry equipment), or a chemical cleaning machine, e.g. one that cleans with and recovers a carbon dioxide- or other solvent-based cleaning agent, for example a dry-cleaning apparatus. Such machines typically include a housing enclosing an electric motor and drive means for rotating a basket for receiving the turnout gear and the cleaning agent during a wash cycle. In addition to carbon dioxide, suitable solvents for use in cleaning turnout gear may include glycol ethers, fatty alcohol polyethylene glycol ethers, linear primary alcohol ethoxylates, cyclic siloxanes and hydrocarbon solvents, among others. The cleaning equipment may also include drying equipment for drying the turnout gear. Various types of drying equipment are known in the art and any suitable drying equipment may be used. The repairing equipment may include one or more sewing machines, hand sewing equipment, heat sealing machines, and suitable repair supplies, such as buttons, hooks, zippers, grommets, replacement reflective trim, sealing tape, fabric, leather, etc.

Optionally, the mobile servicing facility includes a tracking system for recording services performed on the turnout gear. Such a tracking system is particularly useful for ensuring compliance with the recordkeeping guidelines of NFPA 1851. For example, the tracking system may include a personal computer configured with suitable database management software for maintaining a database of services performed for each individual article of turnout gear. For example, each article of turnout gear may be labeled with a unique identification code for this purpose, e.g. on a heat-activated label similar to an "iron-on" patch. The identification code may be human readable, e.g. an alphanumerical string, and/or machine readable, e.g. in the form of a bar code. The tracking system is preferably capable of generating written reports of services performed and/or interfacing with a reporting system for generating such reports.

In some embodiments, the mobile servicing facility is configured to rely upon the fire department's utilities, e.g. electricity, water supply, sewer service, etc., for operation. Preferably, the mobile servicing facility is a "closed" facility. As used herein, a "closed" facility is self-sufficient in that it need not rely upon a fire department's utilities. For example, a closed mobile servicing facility may include power generation equipment, such as an electric power generator powered by an internal combustion engine, for powering electrically powerable cleaning, repairing, tracking and related equipment. Additionally, a closed mobile servicing facility carries water, chemicals, tools, and/or other supplies required for cleaning and repairing turnout gear and stores any waste products or streams for later disposal, recycling or reclamation at an appropriate facility. A closed facility is advantageous in that it simplifies operation of the facility, eliminates the need to connect to fire department utilities, and alleviates possible concerns of the fire department or local authorities about technical details of the servicing process, particularly waste solvent disposal or the disposal of contaminants removed from the turnout gear.

Referring again to FIG. 2, an operator of the mobile servicing facility next receives a firefighter's turnout gear from the fire department, as shown at step 34. The operator initially inspects the turnout gear to determine whether the turnout gear is marked with an identification code, as shown at step 36. If the turnout gear is not so marked, the operator marks the turnout gear with a unique identification code, as shown at step 38. The operator then operates cleaning equipment carried by the mobile servicing facility to clean the turnout gear, as shown at step 40. This step may include operation of power generation equipment to power the cleaning equipment. An exemplary cleaning method describing operation of an exemplary cleaning equipment is discussed below in reference to FIG. 3.

When cleaning is complete, the turnout gear is inspected to determine whether it is damaged, i.e. in need of repair, as shown at step 42 of FIG. 2. If so, the operator operates repairing equipment carried by the mobile servicing facility to repair the turnout gear, as shown at step 44. For example, this step may include replacing worn or missing parts to restore the integrity of the turnout gear, e.g. by operating a sewing machine to replace or repair various components. This step may include operation of power generation equipment to power the repairing equipment.

The operator operates the tracking system carried by the mobile servicing facility to record services performed on the turnout gear, as shown at step 46. This step may include operation of power generation equipment to power the tracking system. For example, this step may include scanning a bar code or otherwise entering the turnout gear's unique identification code into database management software running on a personal computer of the tracking system, and subsequently typing a list or selecting options from a menu of services performed, and causing storing of a list of services performed in association with the unique identification code in a memory of the tracking system. In this example, the tracking system includes a printer and is operated to generate a printed report of services performed on the turnout gear. Alternatively, data representing servicing of turnout gear may be communicated to a reporting system, e.g. outside of the mobile servicing facility, to generate a report of services performed on the turnout gear.

Next, the serviced turnout gear and/or the printed report are provided to the firefighter and/or fire department, as shown at steps 48, 50 and 52. After servicing the desired articles of turnout gear, the mobile servicing facility is removed from the fire department's premises, as shown at step 54 and the method ends, as shown at step 55. The mobile servicing facility may then be transported to another fire department to service that fire department's turnout gear.

Figure 3:
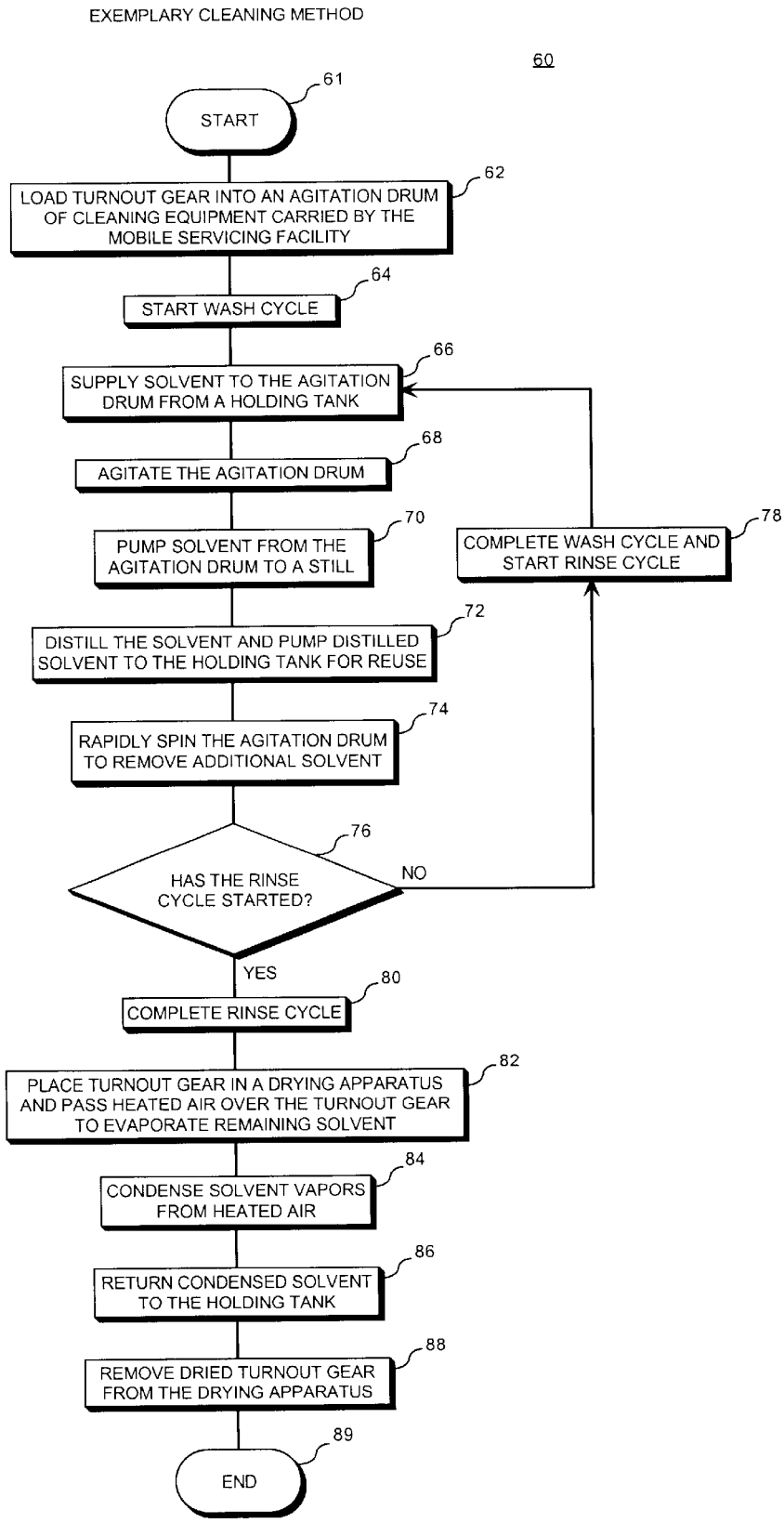
FIG. 3 is a flow diagram providing logic of an exemplary cleaning method in accordance with the example of FIG. 2.

FIG. 3 is a flow diagram 60 providing logic of an exemplary cleaning method in accordance with the example of FIG. 2. For example, the exemplary cleaning method of FIG. 3 may be practiced in step 40 of FIG. 2. The example of FIG. 3 considers exemplary cleaning equipment including drying equipment. Referring now to FIG. 3, the exemplary cleaning method starts with loading of turnout gear into an agitation drum of cleaning equipment carried by the mobile servicing facility, as shown at steps 61 and 62. In this example, the cleaning equipment uses a solvent-based cleaning agent suitable for cleaning turnout gear. Such cleaning equipment and solvents are generally known in the art. Advantageously, the liner and outer shell of coats- and pants-type turnout gear are separated, fasteners on the shell are fastened to prevent snagging, and the liners are everted. Both the liner and shell are loaded into the agitation drum of the cleaning machine.

A wash cycle is then started, as shown at step 64. This results in supplying, e.g. pumping, of solvent to the agitation drum from a holding tank carried by the mobile servicing facility, as shown at step 66. As shown in step 68, the drum is then agitated, e.g. rotated, and the turnout gear is cleaned by the solvent. Approximately thirty to sixty minutes of agitation has been found to be suitable for cleaning of most turnout gear.

In this example, the solvent is then pumped from the agitation drum to a still carried by the mobile servicing facility, as shown at step 70. The solvent is then distilled to purify the solvent and the distilled solvent is pumped to a holding tank for reuse, as shown at step 72. Alternatively, the solvent may be filtered to separate immiscible fluids such as water, oils, etc. A "spin cycle" follows whereby the agitation drum is rapidly spun to remove any additional solvent remaining in the turnout gear, as shown at step 74. For example, any solvent removed in this step may be pumped out, distilled and stored as described above.

The turnout gear is then subjected to a rinse cycle whereby steps 66 through 74 are repeated, as shown at steps 76 and 78. The distilled solvent from step 70 is reused during the rinse cycle and then stored in the holding tank. After the rinse cycle is completed, as shown at step 80, the turnout gear is placed in drying equipment carried by the mobile servicing facility. The drying equipment passes heated air over the turnout gear to dry the turnout gear by evaporating remaining solvent, as shown at step 82. In this embodiment, a diesel-fired boiler is carried by the mobile servicing facility to create steam which is passed through coils in an air flow loop to heat the air. A chiller is also carried by the mobile servicing facility and a refrigerated coil fed by the chiller is also positioned in the air flow loop to condense and thereby recapture solvent vapors from the heated air, as shown as step 84. The condensed solvent is returned to the holding tank for subsequent reuse, as shown at step 86. The turnout gear is removed from the drying equipment, and the method ends, as shown at steps 88 and 89. The turnout gear may then be repaired, etc. as shown in FIG. 2.

In one embodiment, the holding tank includes three separate holding tanks, namely, a first tank for holding heavily contaminated solvent from which the still draws, a second tank for holding clean/distilled solvent which receives solvent from the still, and a third tank for holding slightly contaminated solvent from a previous wash cycle. In such an embodiment, solvent is pumped into the drum, e.g. from the third tank, and the drum is agitated. The solvent is then heavily contaminated and thus is pumped to the first tank to be distilled. Clean/distilled solvent from the second tank is then pumped into the drum for a rinse cycle. After the rinse cycle, the thus slightly contaminated solved is pumped into the third holding tank to be reused for the wash cycle for the next wash load. After the wash cycle for the next wash load, that solvent is heavily contaminated and is pumped to the first tank for distillation, etc.

A 60 kilowatt diesel generator has been found adequate to power the repairing equipment, cleaning equipment, including the drying equipment, and tracking system. A 10 ton chiller has been found adequate for cooling the refrigeration unit on the cleaning machine and to provide cool water for the still, and a 10 horsepower diesel-fired boiler has been found adequate for providing steam for drying and distillation. Diesel fuel tanks are optionally carried by the mobile servicing facility to fuel the generator and boiler. A supplemental electric or steam dryer may optionally be carried on the mobile servicing unit to complete the drying process. Periodically, contaminants are removed from the still and incinerated or otherwise disposed of at an appropriate facility.

Liquified $CO_2$ dry-cleaning solvents, when used, eliminate the need for the boiler and supplemental dryer. Suitable equipment for such dry-cleaning solvents is well known in the art. Such solvents reduce odor and flammability problems as compared with hydrocarbon solvents. Alternatively, water washing/detergent based laundry equipment may be used. Such equipment is also well known in the art.

What is claimed:

1. A method for servicing firefighter's turnout gear comprising the steps of:

(a) transporting a mobile servicing facility onto premises of a fire department facility, said mobile servicing facility being a closed facility comprising cleaning equipment for cleaning firefighter's turnout gear;

(b) operating said cleaning equipment to clean turnout gear of said fire department facility; and (c) transporting said mobile servicing facility away from said fire department facility.

2. The method of claim 1, wherein said cleaning equipment comprises a cleaning machine for use with a carbon dioxide-based cleaning agent.

3. The method of claim 1, wherein said cleaning equipment comprises laundry equipment.

4. The method of claim 1, wherein said cleaning equipment comprises a cleaning machine for use with a dry-cleaning solvent-based cleaning agent.

5. The method of claim 4, wherein step (b) comprises the steps of:

(b1) using a dry-cleaning solvent to clean the turnout gear;

(b2) distilling, in a still carried by the mobile servicing facility, the dry-cleaning solvent used in step (b1); and (b3) storing, in a holding tank carried by the mobile servicing facility, the distilled dry-cleaning solvent for subsequent use in said cleaning equipment.

6. The method of claim 4, wherein the dry-cleaning solvent is selected from the group consisting of glycol ethers, fatty alcohol polyethylene glycol ethers, linear primary alcohol ethoxylates, cyclic siloxanes and hydrocarbon solvents.

7. The method of claim 4, wherein said cleaning equipment further comprises a drying machine, and wherein step (b) comprises the steps of:

(b4) said drying machine circulating heated air to evaporate dry-cleaning solvent from the turnout gear; and (b5) said drying machine condensing dry-cleaning solvent vapors to recapture solvent from the heated air; and (b6) storing, in a holding tank carried by the mobile servicing facility, the condensed dry-cleaning solvent vapors for subsequent use in said cleaning equipment.

8. The method of claim 1, wherein said mobile servicing facility further comprises repairing equipment, and wherein step (b) comprises the step of operating said repairing equipment to repair said turnout gear.

9. The method of claim 8, wherein said repairing equipment comprises a sewing machine.

10. The method of claim 9, wherein said mobile services facility further comprises supplies for repairing firefighters's turnout gear.

11. The method of claim 1, wherein said mobile servicing facility comprises a towable trailer for carrying said cleaning equipment.

12. The method of claim 1, wherein said mobile servicing facility comprises a motor vehicle for carrying said cleaning equipment.

13. The method, of claim 1, wherein said mobile servicing facility further comprises electric power generation equipment for powering said cleaning equipment.

14. A method for servicing firefighter's turnout gear comprising the steps of:

(a) transporting a closed, mobile servicing facility onto premises of a fire department facility, said mobile servicing facility comprising cleaning equipment for cleaning and repairing equipment for repairing firefighter's turnout gear;

(b) operating said cleaning and repairing equipment to clean and, if there is repairable damage to the turnout gear, repair the turnout gear; and (c) removing said mobile servicing facility from the premises of said fire department facility.

15. The method of claim 14, wherein said cleaning and repairing equipment are powerable by electricity and wherein said mobile servicing facility carries an electric power generator, said method further comprising the step of:

(d) generating electric power using said electric power generator; and (e) powering said cleaning and repairing equipment with electric power generated in step (d).

16. The method of claim 15, wherein said mobile servicing facility further comprises a tracking system for recording services performed on the turnout gear, said method further comprising the steps of:

(f) operating said tracking system to record services performed on the turnout gear; and (g) operating said tracking system to create a report identifying such services.

17. The method of claim 15, further comprising the step of:

(f) marking the turnout gear with a unique identification code.

18. The method of claim 17, wherein said mobile servicing facility further comprises a tracking system for recording services performed on the turnout gear, said method further comprising the steps of:

(f) identifying a unique identification code associated with the turnout gear;

(g) operating said tracking system to record services performed on the turnout gear and store an identification of said services in association with said unique identification code; and (h) operating said tracking system to create a report identifying such services.

19. A method for servicing firefighter's turnout gear comprising the steps of:

(a) transporting a mobile servicing facility onto premises of a fire department facility, said mobile servicing facility comprising cleaning equipment for cleaning and repairing equipment for repairing firefighter's turnout gear;

(b) receiving turnout gear from said fire department facility;

(c) operating said cleaning equipment to clean the turnout gear;

(d) inspecting the turnout gear to identify damage;

(e) operating said repairing equipment to repair damage, if any;

(f) returning the serviced turnout gear to said fire department facility; and (g) removing said mobile servicing facility from the premises of said fire department facility.

20. The method of claim 19, wherein said mobile servicing facility further comprises a tracking system for recording services performed on turnout gear, said method further comprising the steps of:

(h) identifying a unique identification code associated with the turnout gear;

(i) operating said tracking system to record services performed on the turnout gear and store an identification of said services in association with said unique identification code; and (j) operating said tracking system to create a report identifying such services; and (k) providing said report to said fire department facility.

21. The method of claim 20, wherein said mobile servicing facility further comprises power generation equipment for powering said servicing equipment and said tracking system, said method further comprising the step of:

(l) operating the power generation equipment to power said cleaning and repairing equipment and said tracking system.

22. The method of claim 21, wherein said mobile servicing facility is a closed facility.

23. The method of claim 19, wherein said servicing equipment comprises cleaning equipment for use with a dry-cleaning solvent-based cleaning agent, and wherein step (d) comprises the steps of:

(d1) loading turnout gear into an agitation drum of said cleaning equipment;

(d2) supplying dry-cleaning solvent to the agitation drum;

(d3) agitating the agitation drum to clean the turnout gear;

(d4) distilling dry-cleaning solvent pumped from the agitation drum to a still;

(d5) storing the distilled dry-cleaning solvent in a holding tank for reuse;

(d6) spinning the agitation drum to remove additional dry-cleaning solvent from the turnout gear;

(d7) passing heated air over the turnout gear to evaporate remaining dry-cleaning solvent;

(d8) condensing dry-cleaning solvent vapors from the heated air passed in step (d7); and (d9) storing the condensed dry-cleaning solvent vapors in the holding tank for reuse.

* * * * *